United States Patent [19]

Langejan

[11] Patent Number: 4,502,405

[45] Date of Patent: Mar. 5, 1985

[54] FLOATING DEVICE COMPRISING STORAGE HOLDS FOR BULK FREIGHT, SUCH AS A HOPPER DREDGE

[75] Inventor: Hendrik Langejan, Krimpen a.d. Lek, Netherlands

[73] Assignee: IHC Holland N.V., Papendrecht, Netherlands

[21] Appl. No.: 320,292

[22] Filed: Nov. 10, 1981

[30] Foreign Application Priority Data

Nov. 11, 1980 [NL] Netherlands ..... 8006153

[51] Int. Cl.[3] ..... B63B 35/30

[52] U.S. Cl. ..... 114/26; 114/36; 414/141

[58] Field of Search ..... 114/36, 37, 27, 73, 114/335, 20, 26; 414/626, 140, 141, 143

[56] References Cited

U.S. PATENT DOCUMENTS

| | | | |
|---|---|---|---|
| 663,801 | 12/1900 | Barney | 114/36 |
| 2,519,453 | 8/1950 | Goodman | 114/335 |
| 3,220,372 | 11/1965 | Lehmann | 114/16 |
| 3,238,954 | 3/1966 | Eriksson | 414/141 |
| 3,918,380 | 11/1975 | Graham et al. | 114/36 |
| 4,138,961 | 2/1979 | Roper | 114/73 |

FOREIGN PATENT DOCUMENTS

| | | | |
|---|---|---|---|
| 1130375 | 5/1962 | Fed. Rep. of Germany . | |
| 386251 | 9/1908 | France . | |
| 739715 | 1/1933 | France . | |
| 1351815 | 3/1963 | France . | |
| 2367690 | 5/1978 | France . | |
| 6414229 | 6/1966 | Netherlands . | |
| 6510377 | 2/1967 | Netherlands . | |
| 7112569 | 3/1973 | Netherlands . | |
| 7710702 | 9/1973 | Netherlands . | |
| 802234 | 10/1958 | United Kingdom | 414/141 |
| 994628 | 10/1965 | United Kingdom . | |
| 1420227 | 7/1976 | United Kingdom . | |
| 1457641 | 8/1976 | United Kingdom . | |
| 2004818 | 11/1979 | United Kingdom . | |

OTHER PUBLICATIONS

Schiff und Hafen, vol. 22, No. 10, Oct. 1970, by Gerhard Hellmich, "Längsgeteilte Klappschuten", pp. 905–908, (p. 905, col. 1, para. 2, FIG 1).

*Primary Examiner*—Sherman D. Basinger
*Attorney, Agent, or Firm*—Young & Thompson

[57] ABSTRACT

A floating device such as a hopper dredge having bottom valves (4–11) for discharging the holds (2), which holds according to the invention can be closed airtight and are provided with apparatus (18) to generate an overpressure within the holds (2), the bottom valves preferably being at a level above the keelline (3) of the device. Movable crane devices (24,26) are provided within the hold to handle components. The holds (2) have a hatch opening with cover (21) to allow entrance or removal of parts (8') which hatch opening can be covered by an inflatable tent (27) attached to the deck.

6 Claims, 2 Drawing Figures

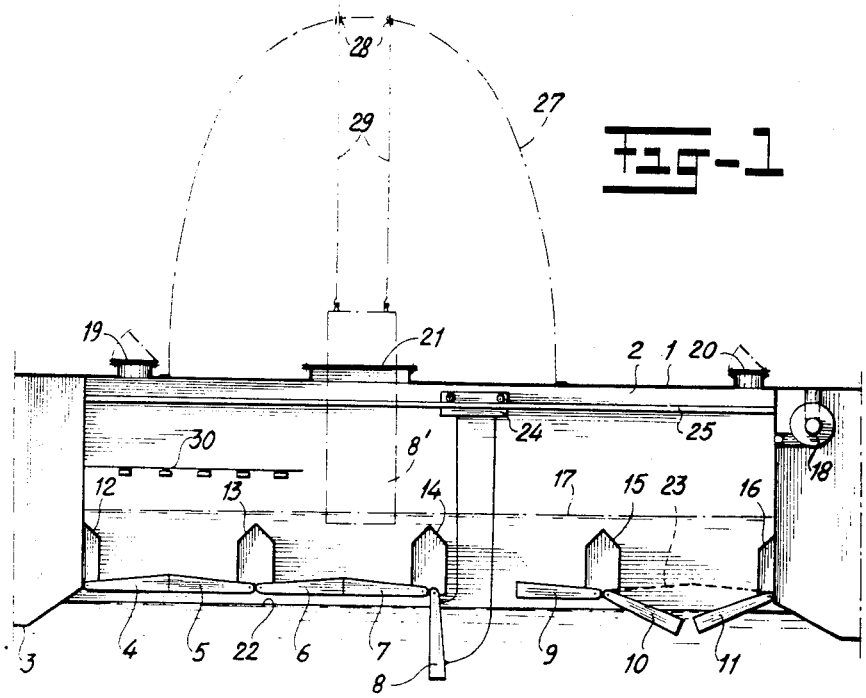
Fig-1
Fig-2
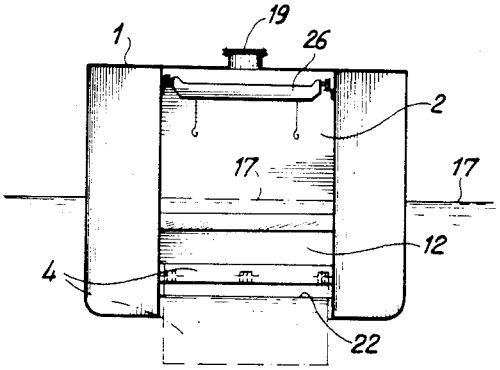

FLOATING DEVICE COMPRISING STORAGE HOLDS FOR BULK FREIGHT, SUCH AS A HOPPER DREDGE

The invention relates to a floating device comprising storage holds for storing bulk freight and means at the bottom level for discharging said bulk freight, such as a hopper dredge with bottom valves. Such a floating device, especially such a hopper dredge, is commonly known. Said devices comprise bottom valves at the bottom level embodied as horizontally slidable doors, downwardly slidable valves or hingedly installed doors. Instead of these downwards discharging means or besides said means it is possible to provide the like hopper dredges with suction channels and conduits for supplying flushing water for creating a mixture which can be pumped through said suction channels. When such a device or hopper dredge respectively is sailing or floating without cargo then the storage holds are filled with water up to a level corresponding with the water level outside the device or hopper dredge respectively. That implies that the discharge means are constantly submerged, which hinders the inspection of said means and the repair of doors, sealing components, operation devices, etc.

An object of the invention is now to provide a solution for this problem.

According to the invention this purpose is achieved in that the storage hold or storage holds can be closed airtight and comprise means for generating an overpressure therein. Because of the airtight sealing it is possible by means of a relatively low overpressure of the order of 1 bar (equal to the pressure difference between the outer and inner water level) to lower the water level inside the hopper such, that the means for discharging the cargo rise above the water level and can be reached for inspection and repairs. The result of this simple measure is that it is no longer necessary to bring the ship into a dock for inspection and repair operations, which is especially important in areas without any docking facilities where the need for continuously carrying out operations is urgent. As the installations become bigger and the suitable docking facilities are farther away or are missing altogether the significance of the invention increases. That applies especially to arctic areas where it is only possible to work during a relatively short time and interruptions of the work are not allowed.

Preferably the discharge means or the bottom of the storage hold or storage holds, which are to be inspected or to be repaired, are positioned at a level above the keelline, because in that case the components to be reached will come faster above the water level and the stability of the installation remains sufficient.

Sealing the storage hold or storage holds can be provided for in a simple way. It is possible to construct the ship from the beginning such, that the storage holds are closed at the upper side by deck plates, in which closable ventilation openings or hatch openings can be provided.

For handling the components it is very useful to install a travelling crab inside the storage hold movable over the whole length of said storage hold.

The closed storage hold can be entered through a ventilation lock, through which also components etc. can be transported.

If the operations have to be carried out on deck then at the upper side of the storage hold one or more hatch openings should be installed of such dimensions, that the biggest components to be handled can be transported therethrough and on deck a crane should be installed to operate through the hatch openings inside the storage holds.

Opening a hatch results of course in quickly losing the overpressure. That causes in itself no problems, because the ship will behave no different from the situation in which none of the bottom valves is open. However, for generating the overpressure a lot of air has to be pumped in, so that the annulment of the overpressure by the opened hatch results in energy loss.

The invention provides for a very simple solution to this problem by setting up an inflatable tent or other closable envelope, sealingly connected to the deck, through the roof of which the hoisting cables of said crane are directed. It is very easy to bring said tent or similar envelope under the same overpressure as the storage hold, whereby the amount of air escaping through the openings through which the hoisting cables are running, is minimum and can be replaced by the compressor supplying the pressurized air. Such a tent or envelope has the advantage that it can be removed after use and offers shelter for the personnel carrying out the operations.

Furthermore it is possible to provide for a ventilation lock for passing personnel and small components.

It is also possible to use a demountable working platform supported in the storage hold, on which new components can be positioned when the hatch covers are opened, respectively from which components to be replaced can be removed, whereas with closed hatch covers in the overpressure situation components to be replaced can be positioned on said working platform and the new components placed thereon can be removed, brought to their destination and installed.

It is to be remarked that the overflow devices can be embodied as telescopic extendable pipes, opening in the keel, i.e. under the noload-water line. Closing these devices is not necessary.

The invention will now be explained in more detail with reference to the attached drawing.

FIG. 1 illustrates schematically longitudinal sectional view through a part of a very big hopper dredge.

FIG. 2 is a transverse sectional view through the hull illustrated in FIG. 1.

The ship's hull 1 illustrated in the Figures has a number of holds, one of which is indicated by 2.

The hull has a keelline 3 and comprises at a higher level valve-doors 4–11 pivotable around horizontal transverse shafts. Said valve-doors are rotatably supported in transverse bracings 12–16. They can be operated using hydraulic cylinders supported in said transverse bracings, which is, however, a known technique.

In FIG. 2 the no-load-water line, which means the water line when the ship is empty, is indicated at 17. In that case the water in the hold 2 stands at the same level.

If for instance by means of a compressor 18 pressurized air is supplied in said hold, then an overpressure will be generated therein when the ventilation openings 19 and 20 and the hatch opening 21 are closed. The water line in the holds will then be lowered to the level 22, so that the valve-doors 4–11 and the complete operating mechanism will arise above the water level whilst preferably the valve-doors 4–11 are slightly opened.

The valve-doors 10 and 11 are illustrated in the partly opened position, and a grating or platform 23 is positioned above said valve-doors by means of which an inspection is possible. It is also conceivable to work from a raft floating in the opening.

A travelling crab 24 is installed inside the storage hold movable transverse to the longitudinal direction of the ship on a bridge, which itself can move over rails 25 in the longitudinal direction. As is illustrated by the valve-door 8 it is possible to attach the hoisting cables of said travelling crab to said valve-door and remove said valve-door after dismounting the pivotable connections.

Instead of a travelling crab, which is movable in the transverse direction, it is also conceivable to use a movable bridge crane 26 extending over the whole width of said storage hold as is illustrated in FIG. 2.

The reference number 30 indicates a temporary working platform on which operations can be carried out and/or components can be stored.

The dash and dot line 27 indicates an inflatable tent positioned on deck and comprising openings 28 in the roof through which the hoisting cables 29 of a not further indicated hoisting crane on deck are guided, by means of which crane a bottom door 8' can be hoisted on deck after opening the hatch 21.

By means of the system according to the invention it is possible to carry out inspection and repair operations at sea without interrupting the normal functioning of the device for an extended time period.

I claim:

1. In a hopper dredge comprising a horizontally elongated storage hold for storing dredged material and a series of valves in the bottom of the hold extending lengthwise of the hold for discharging said dredged material, the water level in the hold being normally above the valves; the improvement comprising means for closing the storage hold substantially air tight, and means for generating an overpressure in the closed storage hold to bring said valves above the water level for inspection or repair of said valves.

2. Hopper dredge according to claim 1, in which the valves in the bottom of the storage hold are positioned at a level a substantial distance above the keel line.

3. Hopper dredge according to claim 1, and a travelling crab inside the storage hold movable over the whole length of said storage hold.

4. Hopper dredge according to claim 1, in which the deck above said storage hold comprises a hatch opening with a hatch cover of such dimensions, that it is possible to transport a said bottom valve through said hatch opening using a crane on deck operating in the space underneath said hatch opening.

5. Hopper dredge according to claim 4, and an inflatable tent on deck covering the hatch opening, the hoisting cables of a said crane running through the tent roof.

6. Hopper dredge according to claim 1, and means for supporting a temporary working platform in said storage hold.

* * * * *